United States Patent [19]

Yamashita et al.

[11] Patent Number: 5,042,266

[45] Date of Patent: Aug. 27, 1991

[54] REFRIGERATING AND HUMIDITY-REGULATING SYSTEM FOR USE IN A CONTAINER

[75] Inventors: Toshio Yamashita; Keitaro Hayami, both of Aichi; Shizuo Fujimoto, Tokyo; Hisaaki Yokota; Akira Hasegawa, both of Kanagawa, all of Japan

[73] Assignees: Mitsubishi Jukogyo Kabushiki Kaisha, Tokyo; Kabushiki Kaisha Kobe Seiko Sho, Hyogo; Mitsui O.S.K. Lines, Ltd., Osaka, all of Japan

[21] Appl. No.: 523,821

[22] Filed: Mar. 30, 1990

Related U.S. Application Data

[63] Continuation-in-part of Ser. No. 263,251, Oct. 27, 1988, abandoned.

[30] Foreign Application Priority Data

Oct. 27, 1987 [JP] Japan ..... 62-163098[U]

[51] Int. Cl.[5] ..... F25D 17/06

[52] U.S. Cl. ..... 62/271; 55/208

[58] Field of Search ..... 62/271; 261/DIG. 34; 55/208, 387, 390

[56] References Cited

U.S. PATENT DOCUMENTS

| | | | |
|---|---|---|---|
| 2,058,919 | 10/1936 | Sewell | 62/271 X |
| 2,075,036 | 3/1937 | Hollis | 62/271 X |
| 2,134,544 | 10/1938 | Ashley | 62/271 X |
| 2,200,243 | 5/1940 | Newton et al. | 62/271 X |
| 2,233,189 | 2/1941 | Altenkirch | 62/271 X |
| 2,441,571 | 5/1948 | Heineman | 62/271 X |
| 3,398,510 | 8/1968 | Pennington | 55/208 X |
| 4,113,004 | 9/1978 | Rush et al. | 165/3 |
| 4,180,985 | 1/1980 | Northrup, Jr. | 62/27 X |
| 4,257,240 | 3/1981 | Christiansen et al. | 62/448 |

FOREIGN PATENT DOCUMENTS

| | | |
|---|---|---|
| 178326 | 4/1986 | European Pat. Off. . |
| 224469 | 6/1987 | European Pat. Off. . |
| 4340 | 5/1934 | Japan . |
| 8800 | 5/1942 | Japan . |
| 47-21994 | 7/1972 | Japan . |
| 50-47251 | 4/1975 | Japan . |
| 57-27554 | 6/1982 | Japan . |
| 63-23454 | 5/1988 | Japan . |

*Primary Examiner*—William E. Tapolcai

*Attorney, Agent, or Firm*—Wenderoth, Lind & Ponack

[57] ABSTRACT

A refrigerating and humidity-regulating system for a container is disclosed, which comprises a refrigerating unit having a humidity-regulating apparatus assembled therein. This humidity-regulating apparatus includes a solid adsorptive material, an air heater, an air blowing means, and an air circulation route for circulating inside and outside air through the air heater and the solid adsorptive material, in that sequence. The solid adsorptive material may be formed as a fixed bed, and inside air and outside air are alternately circulated through the fixed bed. In one preferred embodiment, the above-mentioned humidity-regulating apparatus is assembled in multiple in the refrigerating unit, wherein in each of the humidity-regulating apparatuses the solid adsorptive material is formed as a fixed bed, and inside air and outside air are alternately circulated through the fixed bed in each humidity-regulating apparatus. In one modified embodiment, the solid adsorptive material is formed in a cylindrical shape and disposed rotatably about its own axis, the air circulation route is partitioned into an inside air circulation zone and an outside air circulation zone in such a manner that the cylindrical solid adsorptive material may alternately pass through the inside air circulation zone and the outside air circulation zone during its one revolution, and inside air and outside air are simultaneously and continuously circulated through the respective air circulation zones in the air circulation route.

19 Claims, 5 Drawing Sheets

REFRIGERATING AND HUMIDITY-REGULATING SYSTEM FOR USE IN A CONTAINER

This application is a continuation-in-part of now abandoned application, Ser. No. 07/263,251 filed on Oct. 27, 1988.

BACKGROUND OF THE INVENTION

1. Field of the Invention

The present invention relates to a refrigerating and humidity-regulating system for a container to be used accommodating Freight in a cold storage or refrigerated condition in marine or overland transportation.

2. Description of the Prior Art

Heretofore, in the case where it is necessary to humidify inside air of the above-mentioned type of container, as shown in FIG. 8, a humidifier 02 is disposed within a refrigerating unit 01, and the inside air within a container 03 is circulated as indicated by arrows.

The inside air is sucked into the refrigerating unit 01 through its top portion and is, after being accelerated by a blower 04, cooled in the course of passing through a cooling coil 05, and is subsequently blown out through the bottom portion of the refrigerating unit 01, after being humidified by the humidifier 02.

As the humidifier 02 can be used an ultrasonic humidifier, a steam type humidifier, a centrifugal humidifier, etc., and water is supplied to the humidifier 02 from a water tank 06 disposed within the container 03.

When this humidifying method is employed, since it is necessary to house the water tank 06 for supplying water to the humidifier 02, not only is the freight loading space within the container 03 reduced, but in the event that the container is transported for a long period of time, it may be necessary to supplement the water in the water tank 06, or there may be an inconvenience in that the water within the water tank 06 may possibly become corrupt.

In the case where it is necessary to dehumidify inside air of the container, as shown in FIG. 9, a dehumidifying coil 07 is disposed within a refrigerating unit 01.

The inside air is, as indicated by arrows, sucked into the refrigerating unit 01 through its top portion and made to pass through the dehumidifying coil 07 via a blower 04 and a cooling coil 05. During this process, moisture in the inside air is removed by making it dew on the surface of the dehumidifying coil 07. The water dewed on the dehumidifying coil 07 is collected in a drain pan 08 and discharged to the outside of the refrigerating unit 01.

When this dehumidifying method is employed, since the dehumidifying coil 07 is cooled to a temperature lower than a dew point of the inside air and moisture in the inside air is removed by making it dew on the surface of the dehumidifying coil 07, there is a limit of dehumidification of up to a relative humidity of RH 50%, hence it is extremely difficult to maintain a humidity lower than that value, and also, within a low temperature atmosphere the moisture adhered to the dehumidifying coil 07 would freeze, resulting in the lowering of heat transfer efficiency and degradation of the dehumidifying effect. In order to deal with this problem, if the dehumidifying coil 07 is heated to melt the ice adhered to the coil, the melted water would give off moisture to the inside air, and would result in an inconvenience in that the dehumidifying effect would be halved.

SUMMARY OF THE INVENTION

It is therefore one object of the present invention to provide a refrigerating and humidity-regulating system for a container that is free from the above-mentioned disadvantages of the humidity-regulating system in the prior art.

A more specific object of the present invention is to provide a refrigerating and humidity-regulating system for a container, in which there is no need to dispose a water tank within a container for humidifying the inside air.

Another specific object of the present invention is to provide a refrigerating and humidity-regulating system for a container in which the limit of dehumidification is improved without deteriorating the dehumidifying effect.

According to one feature of the present invention, there is provided an improved refrigerating and humidity-regulating system for a container comprising a refrigerating unit having a humidity-regulating apparatus assembled therein. The humidity-regulating apparatus includes a solid adsorptive material, an air heater and an air blower, and is provided with an air circulation route for circulating inside air and outside air through the air heater and the solid adsorptive material in that sequence.

According to the present invention, and due to the above-mentioned structural features, when humidifying inside air, outside air is circulated through the air circulation route, and during this process, moisture in the outside air is adsorbed by the solid adsorptive material. Subsequently, inside air is circulated through the air circulation route, and during this process, after the inside air has been heated by the air heater, it is humidified by taking moisture away from the solid adsorptive material. On the other hand, in the case of dehumidifying inside air, the inside air is circulated through the air circulation route, and during this process, the inside air is dehumidified by making moisture in the inside air be adsorbed by the solid adsorptive material. Subsequently, outside air is circulated through the circulation route, and during this process, after the outside air has been heated by the air heater, it takes moisture away from the solid adsorptive material and is discharged to the outside.

Thus, according to the present invention, by means of the subject refrigerating and humidity-regulating system, not only cooling of inside air of a container but also humidification and dehumidification of the inside air become possible. Moreover, the dehumidifying effect is so large that the humidity of the inside air can be maintained at a low level. In addition, since a water tank is not necessitated, in contrast to the prior art system, there is no need to sacrifice freight loading space for the water tank, there is no fear that water in a water tank may become corrupt during a long period of transportation, and it is further unnecessary to supplement of the water. Furthermore, since a dehumidifying coil is not necessitated, in contrast with the prior art, mechanisms and operations for removing ice or frost adhered to the dehumidifying coil become unnecessary.

The above-mentioned and other objects, features and advantages of the present invention will become more apparent by reference to the following description of preferred embodiments of the invention taken in conjunction with the accompanying drawings.

BRIEF DESCRIPTION OF THE DRAWINGS

In the accompanying drawings:

FIGS. 1 to 3 jointly show a first preferred embodiment of the present invention;

FIG. 1 is a vertical cross-sectional view of a container;

FIGS. 4 and 5 jointly show a second preferred embodiment of the present invention;

FIG. 5(B) is an operation diagram during dehumidification;

FIGS. 6 and 7 jointly show a third preferred embodiment of the present invention;

FIG. 6 is a vertical cross-sectional view of a container;

DESCRIPTION OF THE PREFERRED EMBODIMENTS

A first preferred embodiment of the present invention will be described with reference to FIGS. 1 to 3.

Figure 1:
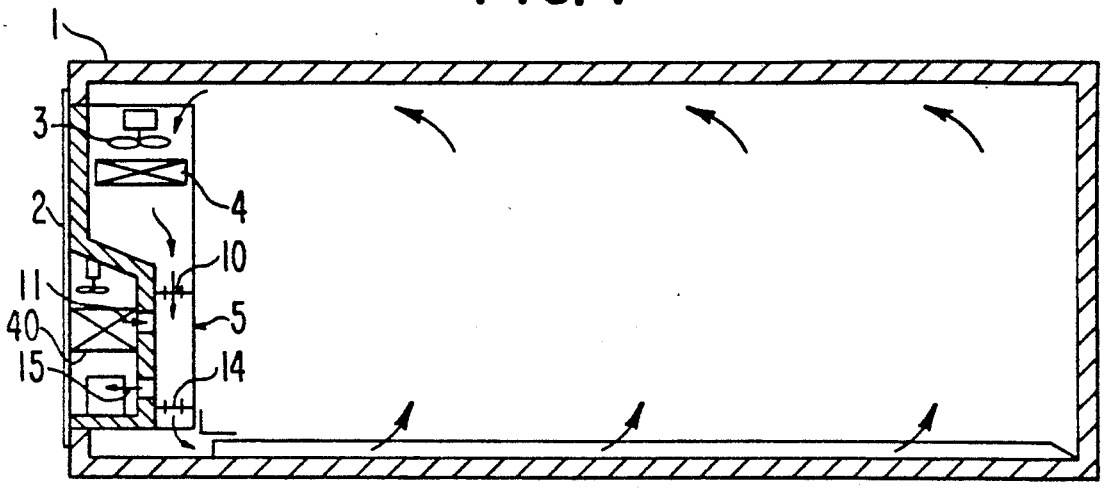

In FIG. 1, reference numeral 1 designates a container, which is provided with a refrigerating unit 2. The refrigerating unit 2 comprises a blower 3 and a cooling coil 4, so that inside air of the container 1 is sucked through a top portion of the refrigerating unit accelerated by the blower 3, and after being cooled by the cooling coil 4, discharged through a bottom portion to be circulated through the container 1, as shown by arrows. The refrigerating unit 2 also has a condensing unit 40 on the outside thereof. Within the refrigerating unit 2 is assembled a humidity-regulating apparatus 5, and as will be apparent from FIG. 2, this humidity-regulating apparatus 5 includes a solid adsorptive material 6 formed as a fixed bed, air heating device 7, such as an electric heater or the like, and an axial flow type fan 8, all contained within a casing 9, which forms an air circulation route. At a top portion of the casing 9 are provided an inside air intake port 10 and an outside air intake port 11, inside air intake port 10 and outside air intake port 11 are adapted to be alternately opened and closed by a damper 13 driven by a damper motor 12. In addition, at the bottom portion of the casing 9 are provided an inside air blow-out port 14 and an outside air blow-out port 15. Inside air blow-out port 14 and outside air blow-out port 15 are adapted to be alternately opened and closed by a damper 17 driven by a damper motor 16. The damper motors 12 and 16 are synchronously energized, and when the dampers 13 and 17 occupy the positions depicted by solid lines, outside air is sucked into the casing 9 through the outside air intake port 11, and is circulated through the fan 8, the air heating device 7, the solid adsorptive material 6 and the outside air blow-out port 15. When the dampers 13 and 17 occupy the positions depicted by dash lines, inside air is sucked into the casing 9 through the inside air intake port 10, and is circulated through the fan 8, the air heating device 7, the solid adsorptive material 6 and the inside air blow-out port 14.

Figure 2A:
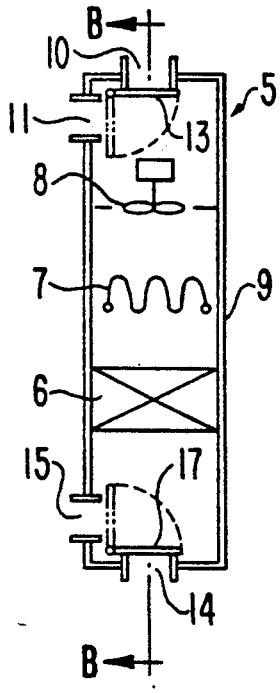
FIG. 2(A) is a vertical cross-sectional view of a humidity-regulating apparatus.
Figure 2B:
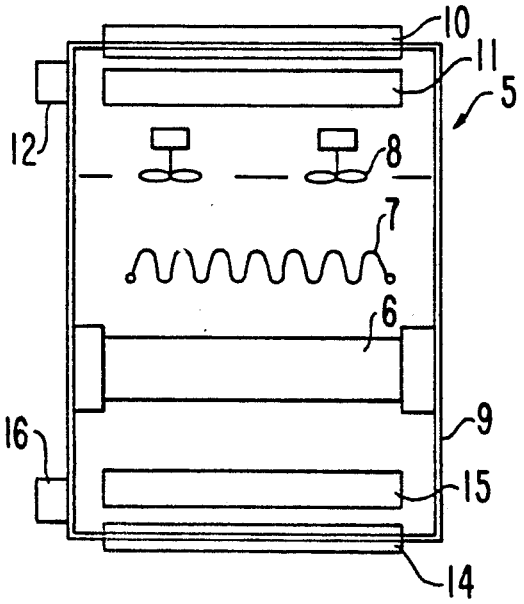
FIG. 2(B) is another vertical cross-sectional view taken along line B—B of FIG. 2(A)
Figure 3A:
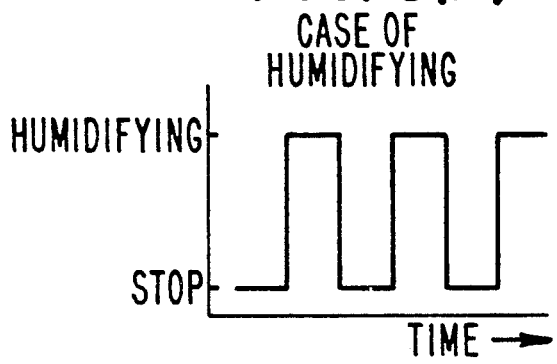
FIG. 3(A) is an operation diagram during humidification.

When humidifying inside air of the container 1, at first the dampers 13 and 17 are driven by the damper motors 12 and 16, respectively, to be switched to the positions shown by solid lines in FIG. 2(A), and thereby the inside air intake port 10 and the inside air blow-out port 14 are closed, while the outside air intake port 11 and the outside air blow-out port 15 are opened. Then, the fan 8 is driven, but the air heating device 7 is not electrically energized. Thus, outside air is sucked by the fan 8 through the outside air intake port 11 into the casing 9. The in the course of air flowing through the solid adsorptive material 6 via the air heating device 7, moisture in the outside air is adsorbed by the adsorptive material 6, and thereafter the outside air is discharged to the outside through the outside air blow-out port 15. When a predetermined period of time has elapsed and the solid adsorptive material 6 has sufficiently adsorbed moisture in the outside air, the dampers 13 and 17 are switched and occupy the positions shown by dash lines in FIG. 2(A). As soon as the outside air intake port 11 and the outside air blow-out port 15 are closed and the inside air intake port 10 and the inside air blow-out port 14 are opened, the air heating device 7 is electrically energized. Then, the inside air is sucked by the fan 8 through the inside air intake port 10 into the casing 9, and in the course of flowing through the air heating device 7 is heated up to a high temperature. Further, in the course of flowing through the solid adsorptive material 6 under this high temperature condition, the inside air is humidified by taking moisture away from the solid adsorptive material 6. Thereafter the air is blown out from the inside air blow-out port 14, and thus is circulated through the inside of the container 1. By repeating the above-mentioned operations alternately at a predetermined repetition cycle as shown in FIG. 3(A), the inside air within the container 1 can be gradually humidified.

Figure 3B:
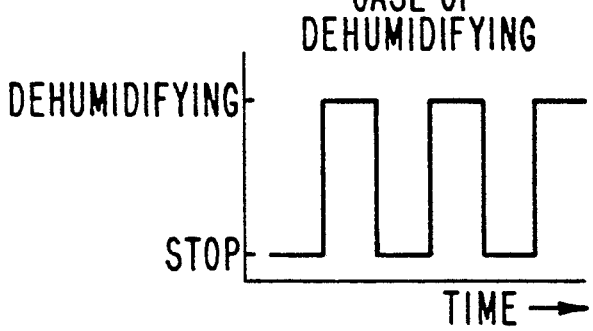
FIG. 3(B) is an operation diagram upon dehumidification.

When dehumidifying the inside air, at first the dampers 13 and 17 are switched to the positions shown by solid lines in FIG. 2(A), and at the same time the fan 8 is driven and the air heating device 7 is electrically energized. Then the outside air enters through the outside air intake port 11 and the fan 8 into the air heating device 7, where it is heated up to a high temperature. Under this high temperature condition the air enters into the solid adsorptive material 6, and after it has taken moisture reserved in the solid adsorptive material 6 away from the solid adsorptive material 6, it flows out to the outside through the outside air blow-out port 15. When a predetermined period of time has elapsed and the solid adsorptive material 6 has been sufficiently dewatered and dried, the dampers 13 and 17 are switched to the positions indicated by dash lines in FIG. 2(A), and at the same time electrical energization of the air heating device 7 is cut off. Then, in the course of the inside air flowing through the solid adsorptive material 6 via the inside air intake port 10, the fan 8 and the air heating device 7, moisture in the inside air is adsorbed by the solid adsorptive material, and thereafter the inside air is blown out through the inside air blow-out port 14. By repeating the above-mentioned operations alternately at a predetermined repetition cycle as shown in FIG. 3(B), the inside air can be gradually dehumidified.

Figure 4A:
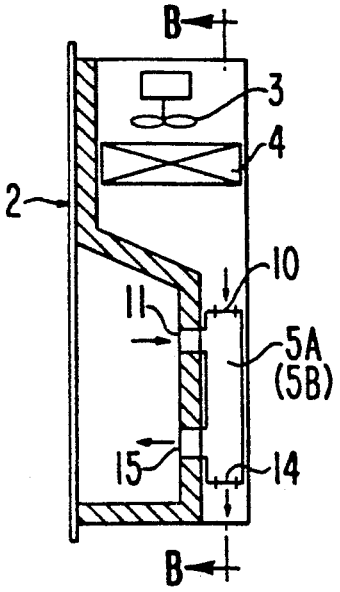
FIG. 4(A) is a vertical cross-sectional view of a refrigerating unit.
Figure 4B:
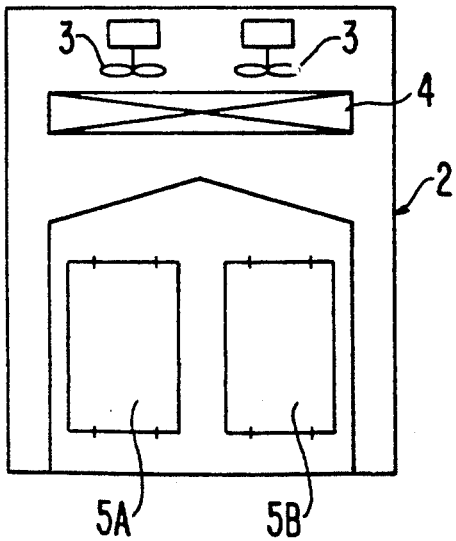
FIG. 4(B) is another vertical cross-sectional view taken along line B—B of FIG. 4(A)
Figure 5A:
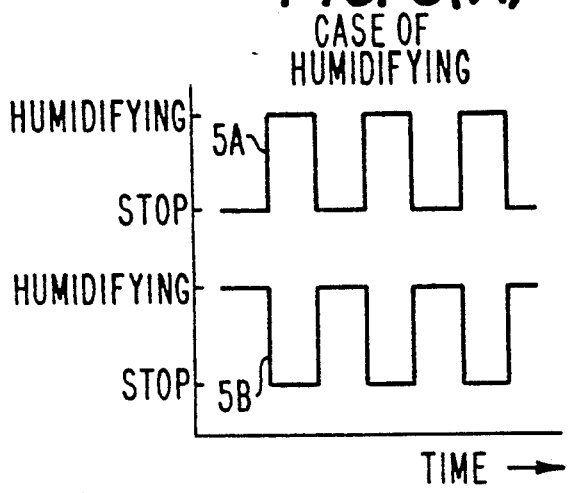
FIG. 5(A) is an operation diagram during humidification.
Figure 5A:
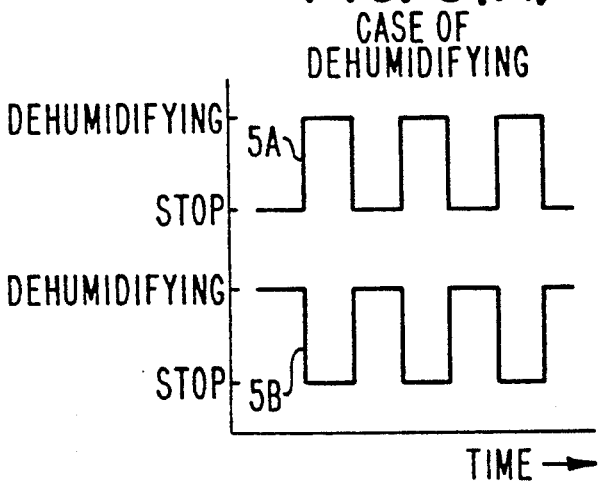

A second preferred embodiment of the present invention is shown in FIGS. 4 and 5. In these figures, a pair of humidity-regulating apparatuses 5A and 5B are assembled in parallel to each other within a refrigerating unit 2. Each of the pair of humidity-regulating apparatus 5A and 5B has the same structure as the humidity-regulating apparatus shown in FIG. 2, and provision is made such that inside air and outside air are alternately fed to the respective ones of the pair of humidity-regulating apparatuses 5A and 5B. Upon humidification of inside air, humidification and interruption are alternately repeated at a predetermined repetition cycle as shown in FIG. 5(A), while upon dehumidification of inside air, dehumidification and interruption are alternately repeated at a predetermined repetition cycle as shown in FIG. 5(B).

Figure 6:
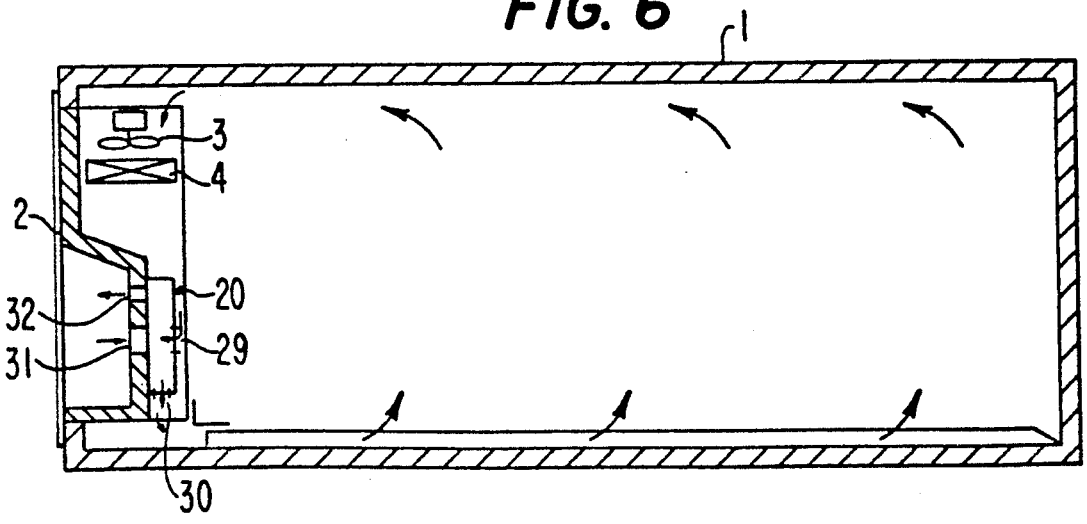
Figure 7A:
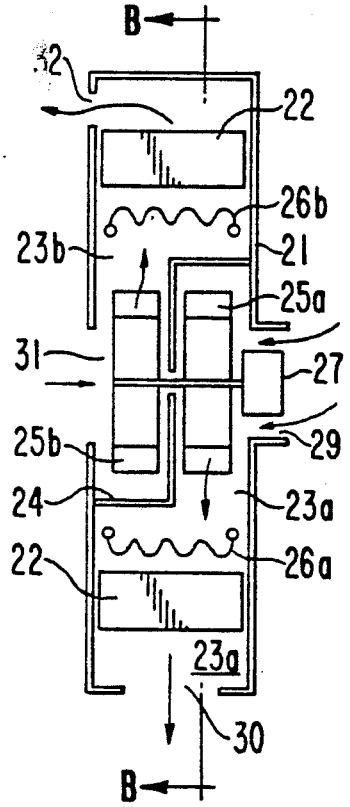
FIG. 7(A) is a vertical cross-sectional view of a humidity-regulating apparatus.
Figure 7B:
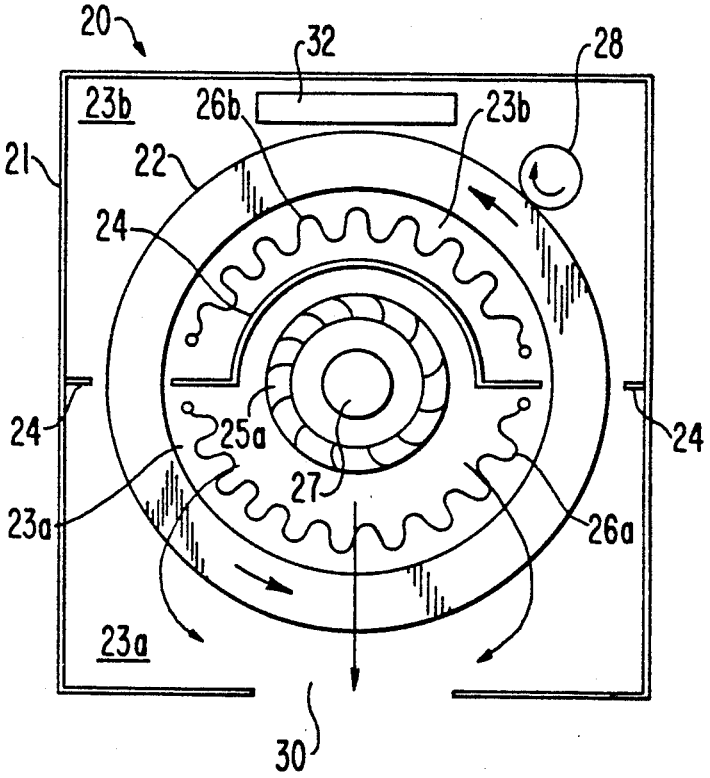
FIG. 7(B) is another vertical cross-sectional view taken along line B—B of FIG. 7(A)
Figure 8:
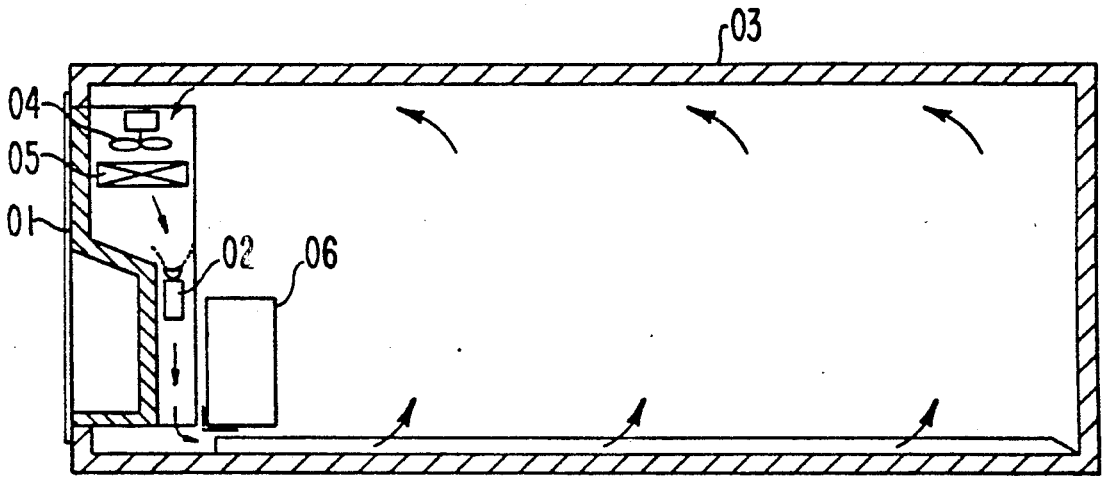
FIG. 8 (PRIOR ART)
FIG. 8 is a vertical cross-sectional view showing a humidification system in a container of the prior art.
Figure 9:
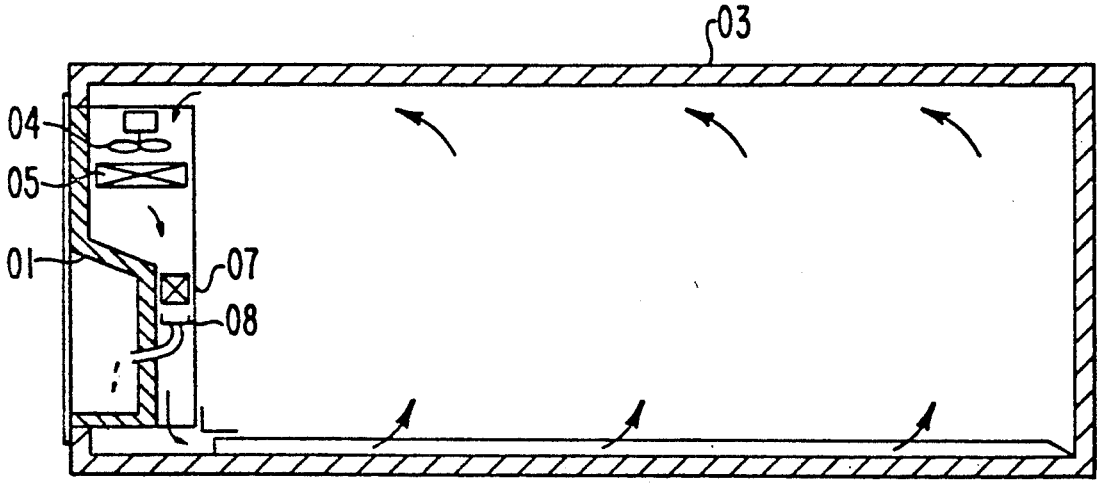
FIG. 9 (PRIOR ART)
FIG. 9 is a vertical cross-sectional view showing a dehumidification system in a container in the prior art.

A third preferred embodiment of the present invention is shown in FIGS. 6 and 7. As shown in FIG. 6, in a refrigerating unit 2 is assembled a humidity-regulating apparatus 20. As shown in FIG. 7, this humidity-regulating apparatus 20 comprises a casing 21 which forms an air circulation route, a cylindrical solid adsorptive material 22 rotably disposed within the casing 21 about its own axis, a partition wall 24 for partitioning the inside and the outside of this cylindrical solid adsorptive material 22 into an inside air circulation zone 23*a* and an outside air circulation zone 23*b*, a radial-flow type fan 25*a* disposed within the inside air circulation zone 23*a* and rotationally driven about the center axis of the cylindrical solid adsorptive material 22, another radial-flow type fan 25*b* disposed within the outside air circulation zone 23*b* and coaxially coupled to the above-mentioned fan 25*a*, air heating device 26*a*, such as an electric heater or the like, disposed between the fan 25*a* and the solid adsorptive material 22 within the inside air circulation zone 23*a*, air heating device 26*b*, such as an electric heater or the like, disposed between the fan 25*b* and the solid adsorptive material 22 within the outside air circulation zone 23*b*, a motor 27 for driving the fans 25*a* and 25*b*, and a motor 28 for rotationally driving the solid adsorptive material 22. The casing 21 is provided with an inside air intake port 29 and an inside air blow-out port 30, both communicating with the inside air circulation zone 23*a*. The casing 21 is also provided with an outside air intake port 31 and an outside air blow-out port 32, both communicating with the outside air circulation zone 23*b*.

When humidifying inside air, the air heating device 26*a* is electrically energized, but the air heating device 26*b* is not electrically energized. Then, outside air sucked by the fan 25*b* through the outside air intake port 31 into the outside air circulation zone 23*b* passes through the unenergized air heating device 26*b* and the solid adsorptive material 22, and it is discharged from the outside air blow-out port 32. Meanwhile, the cylindrical solid adsorptive material 22 is slowly rotated in the direction of arrows by the motor 28, and during its half revolution passing through the outside air circulation zone 23*b*, it adsorbs moisture from the outside air. On the other hand, inside air is sucked by the fan 25*a* through the inside air intake port 29 into the inside air circulation zone 23*a*, and in the course of flowing through the energized air heating device 26*a* it is heated up to a high temperature. Then under this high-temperature condition, the air enters into the solid adsorptive material 22, where it is humidified by taking moisture away from the solid adsorptive material 22. Thereafter the air is discharged from the inside air blow-out port 30. The solid adsorptive material 22 is dewatered by giving the moisture adsorbed from the outside air to the inside air during its half revolution passing through the inside circulation zone 23*a*, and under this dewatered condition it reenters the outside air circulation zone 23*b*.

In the case of dehumidifying inside air, the air heating device 26*b* is electrically energized, but the air heating device 26*a* is not electrically energized. Accordingly, inside air is sucked by the fan 25*a* through the inside air intake port 29 into the inside air circulation zone 23*a*, and when it flows through the solid adsorptive material 22 via the air heating device 26*a*, it is dehumidified and thereafter discharged through the inside air blow-out port 30. At the same time, outside air is sucked by the fan 25*b* through the outside air intake port 31 into the outside air circulation zone 23*b*, and in the course of flowing through the energized air heating device 26*b*, is heated up to a high temperature. Under this high-temperature condition the air enters into the solid adsorptive material 22, where it takes moisture away from the solid adsorptive material 22. Thereafter the air is discharged to the outside from the outside air blow-out port 32.

As will be apparent from the detailed description above, according to the present invention, since a humidity-regulating apparatus including a solid adsorptive material, an air heating device and an air blowing device, and provided with an air circulation route for circulating inside air and outside air through the above-mentioned air heating device and the above-mentioned solid adsorptive material in that sequence, is assembled in a refrigerating unit, in the case of humidifying inside air, moisture in outside air is made to be adsorbed by the solid adsorptive material, and subsequently, inside air is humidified by making it pass through the solid adsorptive material after it has been heated up. In the case of dehumidifying inside air, it is dehumidified by making moisture in the inside air be adsorbed by the solid adsorptive material. And by making outside air flow through the solid adsorptive material after having been heated; the outside air takes moisture away from the solid adsorptive material, the air is discharged to the outside. Thus, by means of the subject refrigerating and humidity-regulating system, not only cooling of inside air of a container, but also humidification and dehumidification of the inside air become possible. Moreover, the dehumidifying effect is so large that the humidity of the inside air can be maintained at a low level. In addition, since a water tank is not necessitated, in contrast to the prior art system, there is no need to sacrifice freight loading space for the water tank, there is no fear that water in a water tank may become corrupt a long period of transportation, and it is unnecessary to supplement of any water. Furthermore, since a dehumidifying coil is not necessitated, as is the case with the prior art, mechanisms and operations for removing ice or frost adhered to the dehumidifying coil also become unnecessary.

Furthermore, if the solid adsorptive material is formed as a fixed bed, as shown in the first preferred embodiment, then dehumidification or humidification of the inside of a container becomes possible by alternately circulating inside air and outside air through the fixed bed.

Still further, if the humidity-regulating apparatus including the solid adsorptive material formed as a fixed bed is disposed in multiple, as shown in the second preferred embodiment, then it becomes possible to continuously carry out dehumidification or humidification of the inside of a container by alternately circulating inside air and outside air through the solid adsorptive materials in the respective humidity-regulating apparatus.

Yet further, as shown in the third preferred embodiment, by forming the solid adsorptive material in a cylindrical shape and disposing it in a rotatable manner, and by partitioning the air circulation route into an inside air circulation zone and an outside air circulation zone and simultaneously circulating inside air and outside air, it becomes possible to continuously carry out dehumidification or humidification of the inside of a container.

While a principle of the present invention has been described above in connection to preferred embodiments of the invention, it is a matter of course that many apparently widely different embodiments of the present invention could be made without departing from the spirit of the present invention.

What is claimed is:

1. A refrigerating and humidity regulating system for a container, including:

a refrigerating unit; and a humidity regulating means in said refrigerating unit for humidifying air in said container with moisture from air outside said container and dehumidifying air in said container by giving moisture to air outside the container, said humidity regulating means comprising:

a casing, an adsorptive material disposed in said casing, means for taking cooled air into said casing from said refrigerating unit, means for discharging air into the container from said casing, means for taking air into said casing from outside of the container, means for discharging air to outside of the container, air heating means for selectively and alternatively heating air circulating to and from the container and air circulating to and from outside the container, to selectively and alternatively humidify and dehumidify the air circulating to and from the container, air blowing means for blowing air taken into said casing through said air heating means and through said adsorptive material, and means for alternately and intermittently exposing a given portion of said adsorptive material to air circulation from outside of said container and air circulation from inside of said container, said means for humidifying and dehumidifying air in said container humidifying the air in said container by said means for alternately and intermittently exposing a given portion of said solid adsorptive material exposing said solid adsorptive material to outside air circulation while said air heating means does not heat the outside air to allow moisture to be adsorbed by said solid adsorptive material, and subsequently having said means for alternately and intermittently exposing a given portion of said solid adsorptive material expose said solid adsorptive material to container air circulation while said air heating means heats the container air such that the heated container air is humidified with the moisture from the outside air, said solid adsorptive material adsorbing sufficient moisture from the outside air and releasing the moisture into the container air to humidify the container air.

2. A refrigerating means for a container, comprising:

a refrigerating means for refrigerating air inside the container, said refrigerating means comprising a cooling unit, a condensing unit, an air passage having a partition wall, and a fan, said cooling unit being disposed inside said air passage such that said fan can circulate air from the container through said air passage and thus through said cooling unit, and said condensing unit being disposed outside of said air passage; and a humidity regulating means in said air passage of said refrigerating means for hu[illegible]ing air in said container with moisture from ai[illegible] side said container and dehumidifying air in said container by giving moisture to air outside the container, said humidity regulating means comprising:

a casing in said air passage at least partly defined by said partition wall of said air passage, a solid adsorptive material disposed in said casing, a first air intake port in said casing communicating with said air passage of said refrigerating means, a second air intake port in said partition wall at said casing for receiving air into said casing from outside of the container, a first air blow-out port communicating with said air passage for discharging air from said casing to the container;

a second air blow-out port in said partition wall at said casing for discharging air from said casing to outside of the container, air heating means for selectively and alternatively heating air circulating to and from the container and air circulating to and from outside the container, to selectively and alternatively humidify and dehumidify the air circulating to and from the container, air blowing means for blowing air received from at least one of said first and second air intake ports, through said air heating means, through said solid adsorptive material, and out at least one of said first and second air blow-out ports, and means for alternatively and intermittently exposing a given portion of said solid adsorptive material to air circulation from said first intake port and air circulation from said second intake port, said means for humidifying and dehumidifying air in said container humidifying the air in said container by said means for alternately and intermittently exposing a given portion of said solid adsorptive material exposing said solid adsorptive material to outside air circulation while said air heating means does not heat the outside air to allow moisture to be adsorbed by said solid adsorptive material, and subsequently having said means for alternately and intermittently exposing a given portion of said solid adsorptive material expose said solid adsorptive material to container air circulation while said air heating means heats the container air such that the heated container air is humidified with the moisture from the outside air, said solid adsorptive material adsorbing sufficient moisture from the outside air and releasing the moisture into the container air to humidify the container air.

3. The refrigerating and humidity-regulating system for a container as set forth in claim 2, wherein:

said solid adsorptive material comprises a fixed bed.

4. A refrigerating and humidity-regulating system for a container as set forth in claim 2, wherein:

said given portion of said solid adsorptive material comprises all of said solid adsorptive material.

5. A refrigerating and humidity-regulating system for a container as set forth in claim 4, wherein:

said means for exposing comprises a first damper for alternately closing off said first and second intake ports and a second damper for alternately closing off said first and second air blow-out ports.

6. A refrigerating and humidity-regulating system for a container as set forth in claim 5, wherein:

said means for exposing further comprises first and second damper motors for moving said first and second dampers, respectively, between said first and second intake ports and said first and second air blow-out ports.

7. A refrigerating and humidity-regulating system for a container as set forth in claim 2, and further comprising a second humidity regulating means in said air passage of said refrigerating means, said second humidity regulating means comprising:

a casing in said air passage at least partly defined by said partition wall of said air passage;

a solid adsorptive material disposed in said casing;

a first air intake port in said casing communicating with said air passage of said refrigerating means;

a second air intake port in said partition wall at said casing for receiving air into said casing from outside of the container;

a first air blow-out port communicating with said air passage for discharging air from said casing to the container;

a second air blow-out port in said partition wall at said casing for discharging air from said casing to outside of the container;

air heating means for selectively heating air inside said casing;

air blowing means for blowing air received from at least one of said first and second air intake ports, through said air heating means, through said solid adsorptive material, and out at least one of said first and second air blow-out ports; and means for alternately and intermittently exposing a given portion of said solid adsorptive material to air circulation from said first intake port and air circulation from said second intake port.

8. A refrigerating and humidity-regulating system for a container as set forth in claim 7, wherein:

said given portion of each said solid adsorptive material comprises all of said solid adsorptive material in a fixed bed in each respective casing, whereby humidity regulation of the inside of the container can be carried out continuously.

9. A refrigerating and humidity-regulating system for a container as set forth in claim 2, wherein:

said adsorptive material is substantially cylindrical in shape and is rotatably mounted in said casing.

10. A refrigerating and humidity-regulating system for a container as set forth in claim 9, wherein:

said means for exposing comprises a first air circulation zone in said casing for exposing said adsorptive material to air circulation from said first air intake port, a second air circulation zone in said casing for exposing said adsorptive material to air circulation from said second air intake port, and motor means for moving said adsorptive material through said first and second air circulation zones.

11. A refrigerating and humidity-regulating system for a container as set forth in claim 2, wherein:

said means for exposing comprises a first air circulation zone in said casing for exposing said adsorptive material to air circulation from said first air intake port, a second air circulation zone in said casing for exposing said adsorptive material to air circulation from said second air intake port, and motor means for moving said adsorptive material through said first and second air circulation zones.

12. A refrigerating and humidity-regulating system for a container as set forth in claim 11, wherein:

said means for exposing has a partition wall separating said first air circulation zone from said second air circulation zone.

13. A refrigerating and humidity-regulating system for a container as set forth in claim 11, wherein:

said air blowing means comprises a first fan for blowing air from said first intake port, through said heating means and said adsorptive material, and out said first air blow-out port, a second fan for blowing air from said second intake port, through said heating means and said adsorptive material, and out said second air blow-out port, and a motor for driving both said fans.

14. A refrigerated freight container, comprising:

a plurality of walls defining a container;

a refrigerating means for refrigerating air inside the container, said refrigerating means comprising a cooling unit, a condensing unit, an air passage having a partition wall, and a fan, said cooling unit being disposed inside said air passage such that said fan can circulate air from the container through said air passage and thus through said cooling unit, and said condensing unit being disposed outside of said air passage; and a humidity regulating means in said air passage of said refrigerating means for humidifying air in said container with moisture from air outside said container and dehumidifying air in said container by giving moisture to air outside the container, said humidity regulating means comprising:

a casing in said air passage at least partly defined by said partition wall of said air passage, a solid adsorptive material disposed in said casing, a first air intake port in said casing communicating with said air passage of said refrigerating means, a second air intake port in said partition wall at said casing for receiving air into said casing from outside of the container, a first air blow-out port communicating with said air passage for discharging air from said casing to the container;

a second air blow-out port in said partition wall at said casing for discharging air from said casing to outside of the container, air heating means for selectively and alternatively heating air circulating to and from the container and air circulating to and from outside the container, to selectively and alternatively humidify and dehumidify the air circulating to and from the container, air blowing means for blowing air received from at least one of said first and second air intake ports, through said air heating means, through said solid adsorptive material, and out at least one of said first and second air blow-out ports, and means for alternatively and intermittently exposing a given portion of said solid adsorptive material to air circulation from said first intake port and air circulation from said second intake port, said means for humidifying and dehumidifying air in said container humidifying the air in said container by said means for alternately and intermittently exposing a given portion of said solid adsorptive material exposing said solid adsorptive material to outside air circulation while said air heating means does not heat the outside air to allow moisture to be adsorbed by said solid adsorptive material, and subsequently having said means for alternately and intermittently exposing a given portion of said solid adsorptive material expose said solid adsorptive material to container air circulation while said air heating means heats the container air such that the heated container air is humidified with the moisture from the outside air, said solid absorptive material adsorbing sufficient moisture from the outside air and releasing the moisture into the container air to humidify the container air.

15. The refrigerating and humidity-regulating system for a container as set forth in claim 2, wherein:

said solid adsorptive material comprises a fixed bed.

16. A refrigerating and humidity-regulating system for a container a set forth in claim 2, wherein:

said given portion of said solid adsorptive material comprises all of said solid adsorptive material.

17. A refrigerating and humidity-regulating system for a container as set forth in claim 4, wherein:

said means for exposing comprises a first damper for alternately closing off said first and second intake ports and a second damper for alternately closing off said first and second air blow-out ports.

18. A refrigerating and humidity-regulating system for a container as set forth in claim 5, wherein:

said means for exposing further comprises first and second damper motors for moving said first and second dampers, respectively, between said first and second intake ports and said first and second air blow-out ports.

19. The refrigerated freight container of claims 14, wherein said refrigerating means and said humidity regulating means together form a unit in one of said plurality of walls of said container.

* * * * *